United States Patent [19]

Borelli et al.

[11] 4,165,686

[45] Aug. 28, 1979

[54] TWO-SIDED NON-IMPACT PRINTING SYSTEM

[75] Inventors: Ronald F. Borelli, Acton, Mass.; Kishor M. Lakhani, Oklahoma City, Okla.

[73] Assignee: Honeywell Information Systems, Inc., Waltham, Mass.

[21] Appl. No.: 839,714

[22] Filed: Oct. 5, 1977

[51] Int. Cl.[2] ..... G03G 13/00; B41F 35/00

[52] U.S. Cl. ..... 101/1; 101/DIG. 13; 346/155; 355/3 CH; 118/648; 118/651

[58] Field of Search ..... 101/1, 426, DIG. 13; 96/1.4, 1 LY; 427/19, 15–17; 118/647, 648, 651, 652, 645, DIG. 23; 346/153–156; 355/3 R, 3 CH, 10; 178/4, 4.1 R, 4.1 A, 4.1 B, 4.1 C, 23

[56] References Cited

U.S. PATENT DOCUMENTS

| | | | |
|---|---|---|---|
| 3,081,698 | 3/1963 | Childress et al. | 346/153 X |
| 3,624,661 | 11/1971 | Shebanow | 101/DIG. 13 X |
| 3,687,107 | 8/1972 | Borelli et al. | 101/DIG. 13 |
| 3,723,645 | 3/1973 | Takami et al. | 346/153 |
| 3,812,780 | 5/1974 | Borelli | 101/DIG. 13 X |
| 3,958,251 | 5/1976 | Borelli | 346/154 |
| 3,983,815 | 10/1976 | Borelli | 101/DIG. 13 |

FOREIGN PATENT DOCUMENTS

| | | | |
|---|---|---|---|
| 7312612 | 9/1973 | Netherlands | 101/DIG. 13 |

OTHER PUBLICATIONS

"Hard Copy and Forms Printer", Hider, IBM Tech. Discl. Bulletin, vol. 9, No. 9, Feb. 1967, pp. 1074–1075.

*Primary Examiner*—E. H. Eickholt

[57] ABSTRACT

A method and apparatus for printing electrographically upon two sides of a chemically pre-treated recording medium, at comparatively high speed such as is required in a computer print-out apparatus.

A pre-treated paper medium comprised of a conductively treated paper base supporting a plastic dielectric coating on each of its sides, is positioned between electrode assemblies comprised of matrices of a plurality of styli which receive variable information from a data processor, or other equipment and by selectively charging the plurality of styli generating a latent image of alphanumeric characters or other variable printing by electrostatic discharge on the paper which is retained by the coating. The latent image is developed, i.e. made visible, by subjecting the paper medium to charged toning particles suspended in a liquid toning carrier. The image is then fixed i.e. made permanent by vaporizing the liquid carrier with heat.

8 Claims, 11 Drawing Figures

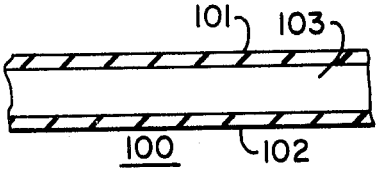

FIG. 1

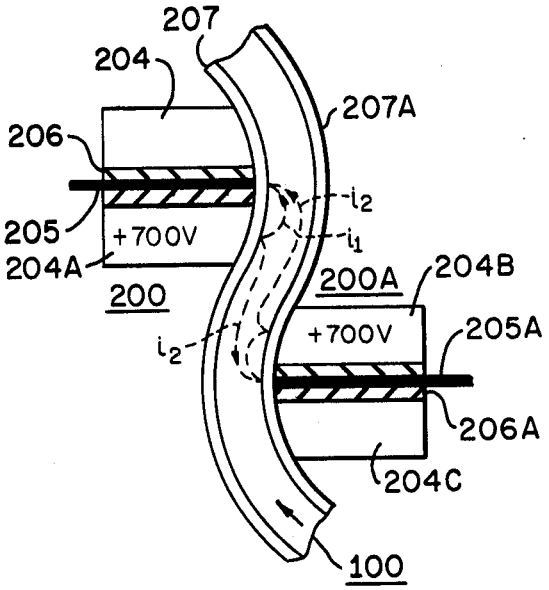

FIG. 2

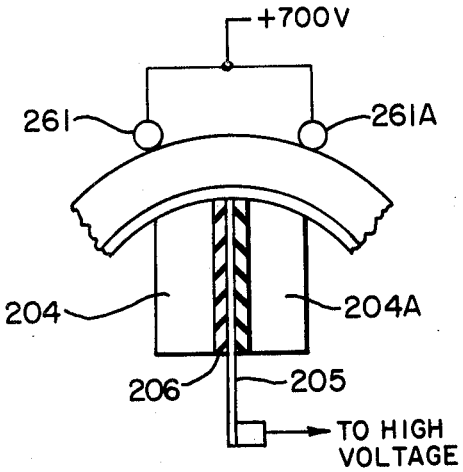

FIG. 2A

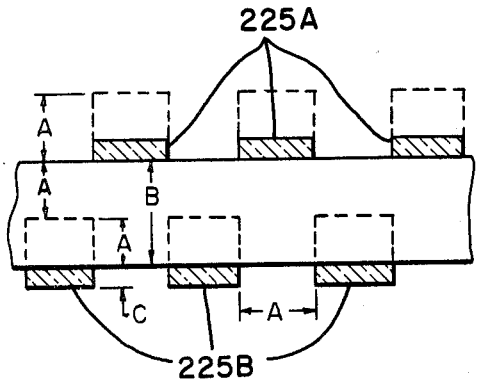

FIG. 2B

| SCAN LINE | ODD | EVEN | ODD | EVEN | ODD | EVEN | ODD | EVEN | ODD | EVEN | ODD | EVEN | ODD |
|---|---|---|---|---|---|---|---|---|---|---|---|---|---|
| 1 | $t_1$ | $t_3$ | $t_1$ | $t_3$ | $t_1$ | $t_3$ | $t_1$ | $t_3$ | $t_1$ | $t_3$ | $t_1$ | $t_3$ | $t_1$ |
| 2 | $t_2$ | $t_4$ | $t_2$ | $t_4$ | $t_2$ | $t_4$ | $t_2$ | $t_4$ | $t_2$ | $t_4$ | $t_2$ | $t_4$ | $t_2$ |
| 3 | $t_3$ | $t_5$ | | | | | | | | | | | |
| 4 | $t_4$ | $t_6$ | | | | | | | | | | | |
| 5 | $t_5$ | $t_7$ | | | | | | | | | | | |
| 6 | $t_6$ | $t_8$ | | | | | | | | | | | |
| 7 | $t_7$ | $t_9$ | $t_7$ | $t_9$ | $t_7$ | $t_9$ | $t_7$ | $t_9$ | | | | | |
| 8 | $t_8$ | $t_{10}$ | $t_8$ | $t_{10}$ | $t_8$ | $t_{10}$ | $t_8$ | $t_{10}$ | | | | | |
| 9 | $t_9$ | $t_{11}$ | | | | | | | | | | | |
| 10 | $t_{10}$ | $t_{12}$ | | | | | | | | | | | |
| 11 | $t_{11}$ | $t_{13}$ | | | | | | | | | | | |
| 12 | $t_{12}$ | $t_{14}$ | | | | | | | | | | | |
| 13 | $t_{13}$ | $t_{15}$ | | | | | | | | | | | |
| 14 | $t_{14}$ | $t_{16}$ | $t_{14}$ | $t_{16}$ | $t_{14}$ | $t_{16}$ | $t_{14}$ | $t_{16}$ | $t_{14}$ | $t_{16}$ | $t_{14}$ | $t_{16}$ | $t_{14}$ |
| 15 | $t_{15}$ | $t_{17}$ | $t_{15}$ | $t_{17}$ | $t_{15}$ | $t_{17}$ | $t_{15}$ | $t_{17}$ | $t_{15}$ | $t_{17}$ | $t_{15}$ | $t_{17}$ | $t_{15}$ |

FIG. 2C

FOR 25 MΩ I□ RESISTIVITY AND 600 pf/cm$^2$ CAPACITANCE PAPER NOMINAL VALUES* OF THE RESISTANCE AND CAPACITANCE FOR 11" WIDE PAPER ARE;

| | | | |
|---|---|---|---|
| $R_{b1}$ = | 2000 MΩ | $C_{F1}$ = | 2000 pf |
| $R_{F1}$ = | 72 MΩ | $C_{C1}$ = | 28000 pf |
| $R_{F2}$ = | 72 MΩ | $C_{F2}$ = | 2000 pf |
| $R_{FV}$ = | 320 MΩ | $C_{V1}$ = $C_{V2}$ = | 25pf |
| $R_{V1}$ = | 4 MΩ | $C_{C2}$ = $C_{C3}$ = | 12000pf |
| $R_{V2}$ = | 8 MΩ | | |
| $R_{V3}$ = | 4 MΩ | | |
| $R_{b2}$ = | 1200 MΩ | | |

*THESE VALUES WILL VARY ACCORDING TO THE PAPER PROPERTY VARIATION.

TWO-SIDED NON-IMPACT PRINTING SYSTEM

RELATED ARTICLES, APPLICATIONS AND PATENTS (1) "A Non-Impact Page Printing System", by R. F. Borelli, R. B. Bayless and E. R. Truax, published in the *Honeywell Computer Journal*, Volume 8, No. 2, pages 67–80 in 1974.

(2) "A Non-Impact Page Printing System", by R. F. Borelli, R. B. Bayless and E. R. Truax, published in *Computer Magazine* of the Institute of Electrical and Electronic Engineers, 5855 Haples Plaza, Long Beach, Calif., in Sept., 1975. (Condensed version of above article).

(3) U.S. Pat. No. 3,867,107, issued to Ronald F. Borelli, et al 8/29/72, entitled "Printing System", and assigned to Honeywell Inc., the parent corporation of the instant assignee.

(4) U.S. Pat. No. 3,624,661, issued to Michael S. Shebanow and Ronald F. Borelli 11/30/71, entitled "Electrographic Printing System with Plural Staggered Electrode Rows", and assigned to Honeywell Inc., the parent corporation of the instant assignee.

(5) U.S. Pat. No. 3,958,251, issued to Ronald F. Borelli 5/18/76, entitled "Electrographic Printing System Utilizing Multiple Offset Styli", and assigned to Honeywell Information Systems Inc., the same assignee as the instant invention.

(6) U.S. Pat. No. 3,812,780, issued to Ronald F. Borelli 5/28/74, entitled "Electrographic Forms Print Station", and assigned to the same assignee as the instant invention.

(7) U.S. Pat. No. 3,839,071, issued to Ronald F. Borelli and Donald J. Garanol 10/1/74, entitled "Printing Method", and assigned to Honeywell Inc., the parent corporation of the instant assignee.

(8) U.S. Pat. No. 3,983,815, issued to Ronald F. Borelli 10/5/76, entitled "Apparatus and Method for Printing on Plain Paper", and assigned to the same assignee as the instant invention.

BACKGROUND OF THE INVENTION

1. Field of the Invention

The invention relates to an apparatus and method for printing upon a recording medium and more particularly to an apparatus for printing permanent images electrographically upon two sides of a paper medium at comparatively high speeds as is required in a computer print-out apparatus.

2. Description of the Prior Art

It had long been recognized that computer peripherals, particularly computer print-out apparatus, were bottlenecks in the total performance of a computer system. The majority of hard-copy output devices for computer systems were and still are comprised of printers which impact the paper medium with print hammers. The movement of such print hammers not only limits the speed at which read-out can be accomplished but are noisy and difficult to maintain. In order to increase the speed, facilitate maintenance, and still maintain print quality, a system was developed and is now being marketed commercially by Honeywell information Systems Inc. utilizing electrographic techniques to accomplish non-impact printing. Such a printing system which prints electrographically on one side only of a pre-treated paper medium is disclosed in the above cited U.S. Pat. No. 3,687,107 issued Aug. 29, 1972.That patent teaches how to print on one side of a recording medium by exciting the recording medium with energy corresponding to the shapes to be printed, developing it and drying, by squeezing the paper between two surfaces at least one of which is absorbent, and then scraping the absorbent surface so as to render it absorptive again.

Another U.S. Patent also issued to Honeywell Inc. on Nov. 30, 1971 having U.S. Pat. No. 3,624,661 pertains to an electrographic printing system, having a multiple electrode structure wherein successive rows are mutually spaced from each other, each row including mutually spaced electrodes, the electrodes of successive rows being positioned in a staggered manner with respect to each other.

U.S. Pat. No. 3,958,251 discloses an electrographic printer provided with multiple row electrode structure wherein the electrodes in each row are mutually spaced one from the other and the electrodes of successive rows are staggered with respect to one another.

U.S. Pat. No. 3,812,780 discloses an electrographic printing device provided with a forms print station including an electrode drum having forms information raised therein which operates on a dielectric print medium.

U.S. Pat. No. 3,839,071 discloses a method of printing wherein a latent image is first formed on a recording medium and thereafter developed by applying a toning liquid to the recording medium.

U.S. Pat. No. 3,983,815 discloses a method and apparatus for electrographically printing on a dielectric paper and transferring a toned image from the dielectric paper to plain paper.

The above cited articles of Paragraphs 1 and 2, on page 2, also describe the non-impact page printing system now being marketed by Honeywell Information Systems Inc.

The above system significantly increased the printing speed from approximately 1110 lines per minute for a high speed impact printer to approximately 18,000 lines per minute for the non-impact page printer.

Further improvements in number of lines per minute printed without increasing speed of travel of the recording medium, can be effected by printing simultaneously on both sides of the recording medium. However, in order to successfully do this without sacrificing print quality, several problems must be overcome. One problem is the application and retention of electric changes on the recording medium without breakdown of the air gap between electrodes on opposite sides of the medium. For example, with the printing of variable information on any side of the recording medium it is generally required to place formatting information on the recording medium. When using only one side of the recording medium this is relatively simple since the voltage breakdown of the air gap is not exceeded. However, when two sides of the recording medium are utilized for printing, the total applied voltage between format drum and electrode assembly can exceed the air breakdown voltage and spark over because of the two electrodes on opposite sides of the paper. Yet too little voltage will not provide for requisite print quality. Accordingly, relative spacing and size of format drums and electrodes, and relative thickness of dielectric as well as total thickness and the recording medium is of utmost importance.

Another problem is the matter of developing and fixing the latent images on two sides of the recording medium instead of one. These and other problems encountered do not offer trivial solutions.

OBJECTS OF THE INVENTION

It is a primary object of the invention to provide an improved non-impact printing system.

It is another object of the invention to provide an improved non-impact page printing system.

It is a further object of the invention to provide a non-impact printing system whereby electrostatic images are placed, developed and fixed on both sides of a paper medium substantially simultaneously.

These and other objects of the invention will become apparent from the description of a preferred embodiment of the invention when read in conjunction with the drawings contained herein.

SUMMARY OF THE INVENTION

The foregoing objects of the instant invention are achieved by a method and apparatus for printing electrographically upon two sides of a prepared recording medium, at comparatively high speed such as is required in a computer print-out apparatus.

A pre-treated paper medium comprised of a conductively treated paper base supporting a plastic dielectric coating on each of its two sides, is positioned between at least two electrode assemblies each assembly comprised of a matrix of styli which receive variable information from a data processor, or other apparatus; these are the electric printheads. By selectively charging the plurality of styli a latent image of alphanumeric characters or other variable printing is generated by the electrostatic discharge on the paper which is retained by the plastic coating. The latent image is then developed by subjecting the paper medium to charged toning particles suspended in a liquid toning carrier. The residual electrostatic field of the dielectric surfaces on either side of the paper attracts these particles and holds them, thus making the images visible. Subsequent vaporization of the liquid carrier removes the vapor leaving the particles behind, which harden and make a permanent bond with the plastic coated surface.

BRIEF DESCRIPTION OF THE DRAWINGS

FIG. 1 is a schematic cross sectional view of a typical coated paper utilized by the invention.

FIG. 2 is a schematic drawing of a portion of an electrode matrix for applying electric charges to the paper medium.

FIG. 2A is a schematic drawing of an electrode assembly with at least one printhead of a matrix of styli.

FIG. 2B is a schematic drawing of a printhead assembly illustrating two rows of offset print styli.

FIG. 2C is a schematic representation of the printed character "E" formed by a 13×15 printhead matrix.

DESCRIPTION OF THE PREFERRED EMBODIMENT OF THE INVENTION

Figure 3:
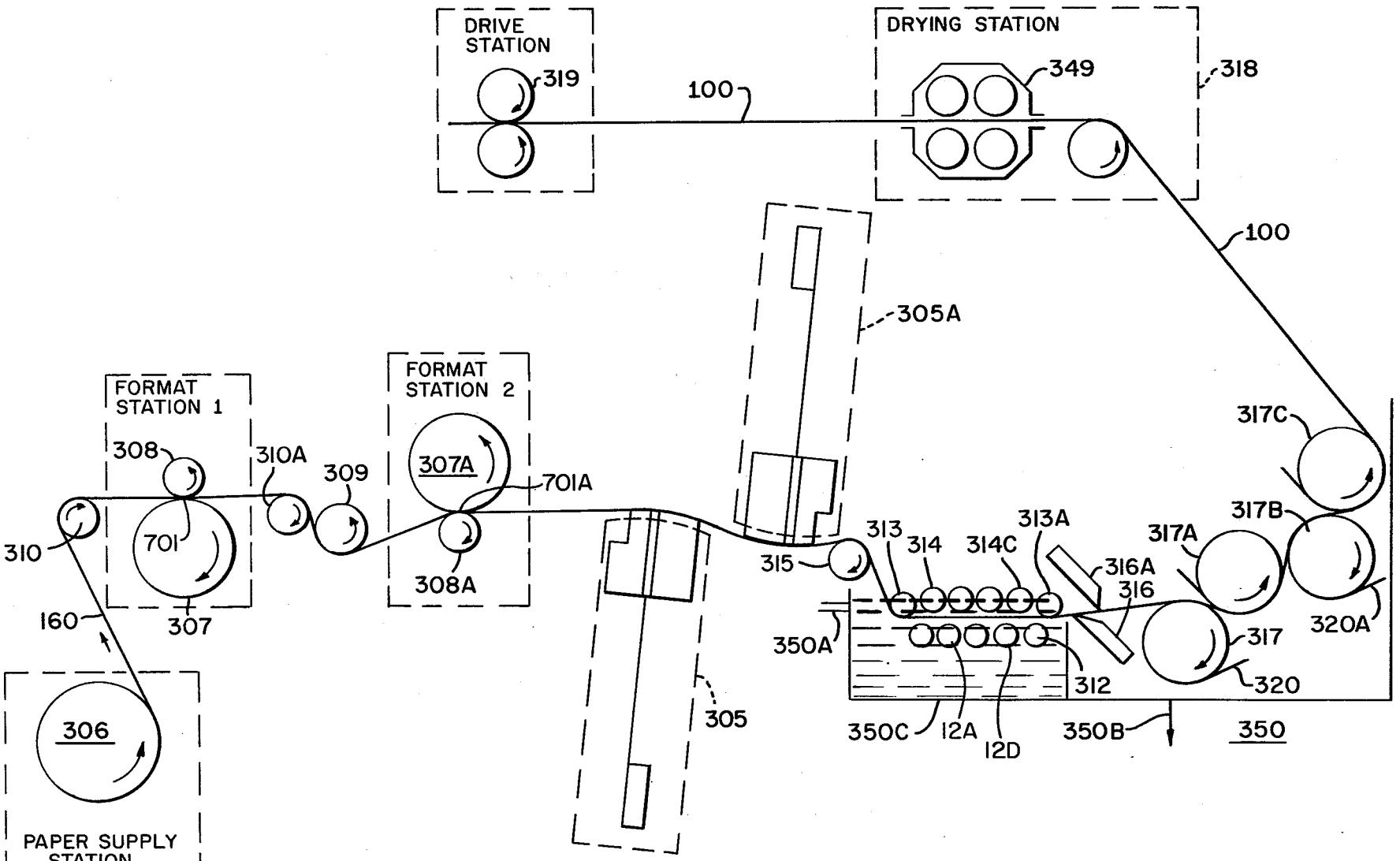
FIG. 3 is a schematic drawing of the two-sided non-impact printing system.

Referring to FIG. 1 there is shown a schematic drawing of the recording medium for use on a two-sided non-impact printing system. A dielectric sandwich 100 approximately 3.2 mils thick, has a conductive paper base 103 approximately 2.8 mils thick. On either side of the conductive base 103 there is a dielectric coating 101 and 102 each approximately 0.2 mils thick. The conductive paper base is made conductive by utilizing conductive salts such as DOW-34, ECR or CALGON-261. The resistivity of the conductive base 103 is between 5–50 meg ohms, whereas the resistivity of the dielectric layer is 200–1000 meg ohms. The capacitance of the dielectric layer is approximately 400–1000 pf/cm$^2$. It is only necessary to adjust the conductivity of the base to provide for just enough current carrier flow or charges to pass through that base. This dielectric sandwich paper supply is mounted on a paper supply roller 306 (FIG. 3) and guided through various stations shown on FIG. 3 where the electrographic printing is accomplished automatically.

Referring to FIG. 3, a treated recording medium 100 is unwound from spindle 306 in the paper supply station and is guided over idler roller 310 to format station 1. The treated recording medium 100 then winds around another idler roller 310A over a charging roller 309 to format station number 2. Format station number 1 (to be more fully described infra with respect to FIGS. 4A and 4B), is comprised mainly of a conductive roller 307 and a back-up resilient non-conductive roller 308. Format station number 1 shares along with format station number 2, charging roller 309 which is maintained approximately at 1200 volts. Format station number 2 for imprinting a format on the other side of the recording medium is also comprised of a conductive roller 307A and a resilient non-conductive back-up roller 308A, and shares along with format station number 1 charging roller 309 which is maintained at 1200 volts. Each conducting roller 307 and 307A has on its surface the format which will be imprinted on the treated recording medium first as a latent image and then later developed and fixed to a permanent format on the recording medium. After receiving the electric charges from format stations 1 and 2, the treated recording medium passes between at least two electrode assemblies 305 and 305A on either side of its surface. It is to be understood that any number of electrode assemblies may be utilized depending upon the width of the treated recording medium and the number of characters to be printed thereon. Each electrode assembly is comprised of a plurality of styli embedded in a non-conducting medium which in turn is surrounded by a conductive material known as the target electrode. The electrode assemblies (to be described more fully infra) receive variable information from a data processor (not shown) or other apparatus, and by selectively charging the plurality of styli, a latent image of alphanumeric characters or other variable printing is generated by the electric discharge on the paper which is retained by the plastic coating on the paper. (See the Non-Impact Page Printing System articles previously referred to for further details with respect to the creation of a typical character image).

The next station that the treated paper passes through is the toner station 350 which is an immersion type. Liquid toner is pumped to the toner station reservoir 350C at toner inlet 350A; excess liquid can be removed through toner outlet 350B. The dielectric paper is guided through the toner liquid via a series of rollers 312–314 on either side of the treated paper. Upon emerging from the toner reservoir 350C, the excess toner liquid on the dielectric paper is scraped off with scrapers 316 and 316A. The dielectric paper is then guided between drying rollers 317–317C. Each drying roller is equipped with a wiper blade 320, 320A, etc. in order to wipe the excess toner liquid after emerging from each drying roller. The treated paper 100 then is guided to drying station 318 where hot air is blown onto the treated paper 100 on both sides thus evaporating the carrier liquid and leaving the toner particles embedded in the paper. The vaporized liquid carrier is then directed into a reclamation station (which is not shown here) where it is eventually condensed into liquid form and reused. Drive station 319 which is comprised of at least two metallic rollers provides the driving force which pulls the treated paper through the various stations.

Figure 5:
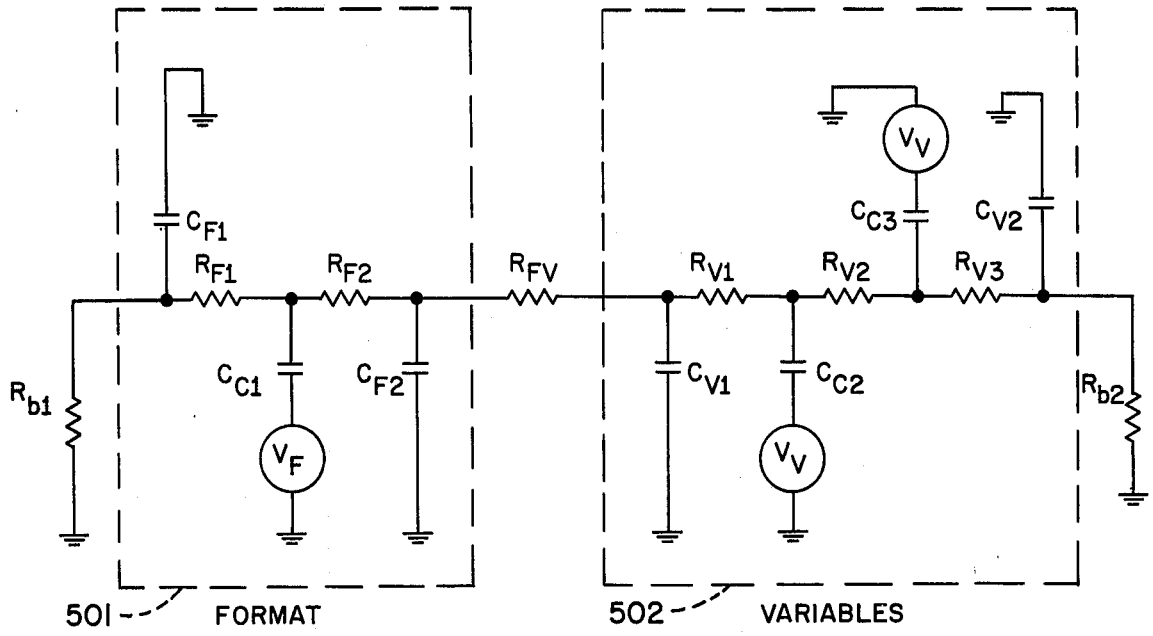
FIG. 5 is an equivalent circuit diagram for the two-sided charging process.

Referring now to FIGS. 2, 2A and 5, the variable printing will be described. A typical electrode assembly shown on FIG. 2A is comprised of double sided one-ounce copper laminated to 216 μm Teflon substrate, which is embedded in an insulating medium 206 which in turn is surrounded by at least two target electrodes 204 and 204A. The target electrode are at a potential of about 700 volts. A typical print head assembly employing a double-sided printed circuit technology is shown on FIG. 2B. The printhead assembly is constructed from double-sided one-ounce copper laminated to a 216 μm Teflon substrate. The conductors 225A and 225B form two rows of offset print styli, and are terminated at the base of the electrode assembly in twenty-four 88-pin connectors. Mating connectors are then used to connect the high-voltage drive electronics to the printhead assembly. The individual conductors in the printhead assembly are coated with a high dielectric strength material to eliminate interelectrode breakdown. Two wear blocks, bonded one to each side of the printed circuit at the styli end, complete the assembly.

The scan line of each matrix character to be imaged is formed by two rows of electrode pins which when energized produce 127 μm square images on the dielectric coated paper surface. The two rows of offset styli are designed to eliminate the voids found in most dot matrix character printing. The circuit path for imaging is formed by passing the paper between two conductive rods 261, 261A as shown on FIG. 2A and 204, 204A–C (FIG. 1). (These electrodes are also known as target electrodes). The rods (target electrodes) provide a high voltage for the high voltage styli on the opposite dielectric side from the dot images. The two rows of styli are designated as odd and even rows. The odd row of styli is used to generate the odd numbered scan line dots, and the even row generates the even number dots. The vertical motion of the paper (perpendicular to the access of the styli rows) is synchronized with a vertical scan for character formation. The 38 μm thick electrodes form dot images which are 127 μm square by allowing paper to move a short distance while the styli remains energized. By leaving the styli energized the paper is "dragged" past the printhead, an image is formed which is independent of the exact thickness of the styli.

FIG. 2C illustrates by way of example, the formation of a matrix character image by the printhead. Only a single character "E" is shown in the figure for illustrative purposes, but it should be understood that all the characters for a single line are formed at the same time. The character shown is formed using a 13×15 matrix. The time sequence of the character formation is indicated by labelling the dots form with the designations $t_1$ through $t_{17}$. The lower numbered dots are formed first. As the paper passes the odd row of electrodes, the odd dots of the first scan line are imaged by energizing the appropriate styli in the odd row of electrodes. These electrodes remain energized until the paper motion has caused the dot images to be "dragged" to a 127 μm height. The dots so formed are labelled $t_1$ in the figure. Next, the odd row of electrodes is again energized, but now those styli required to form the dots in the second scan line are activated. The driving process again occurs and the 127 μm square image is of the second scan line are created. These dots are labelled $t_2$. When the second scan line odd dots have been completed, the first scan line even dot positions have become aligned at the even electrode row, and are ready to be imaged. The imaging of the even dots in the first scan line occurs during the next time interval. These dots are labelled $t_3$. This process continues until the entire character has been imaged. The even dots for the last two scan lines are imaged without energizing any odd electrode styli to balance the effect of imaging the initial odd dots before activating any even electrodes. The resulting character image is free of undesirable voids.

Typically, the print head has 2112 styli in two rows of 1056 each, for an effective length of 268.2 mm for character formation. This permits 132 of the smaller characters in a single line (3 dots to spare), or 105 of the larger characters (12 dots to spare). See also above referenced U.S. Pat. No. 3,624,661 for further details.

FIG. 2 schematically illustrates the placing of the electrode assemblies 200 and 200A in a typical offset manner on either side of treated paper 100. Also shown on FIG. 2 are typical current flows $i_1$ and $i_2$ within the conductive base of treated paper 100 to place charges on the dielectric 207, 207A. Understanding of the current flow can be developed from simplified charging circuit shown on FIG. 5.

Referring to FIG. 5 there is shown the equivalent circuit diagram for two-sided charging at the format station 501 and variable station 502. $R_{b1}$ is the resistance along the base paper to ground of the base of the treated conducting medium. $C_{f1}$ and $C_{f2}$ are the capacitances of the format drum contact (701 and 701A of FIG. 3) with the dielectric coded medium 100. $R_{f1}$ and $R_{f2}$ are the base paper resistances between format electrodes 307, 309 and 307A respectively. $V_f$ is the applied format potential on roller 309, $C_{v1}$ and $C_{v2}$ are the variable capacitances for electrode head styli (electrode head pins).

Figure 4:
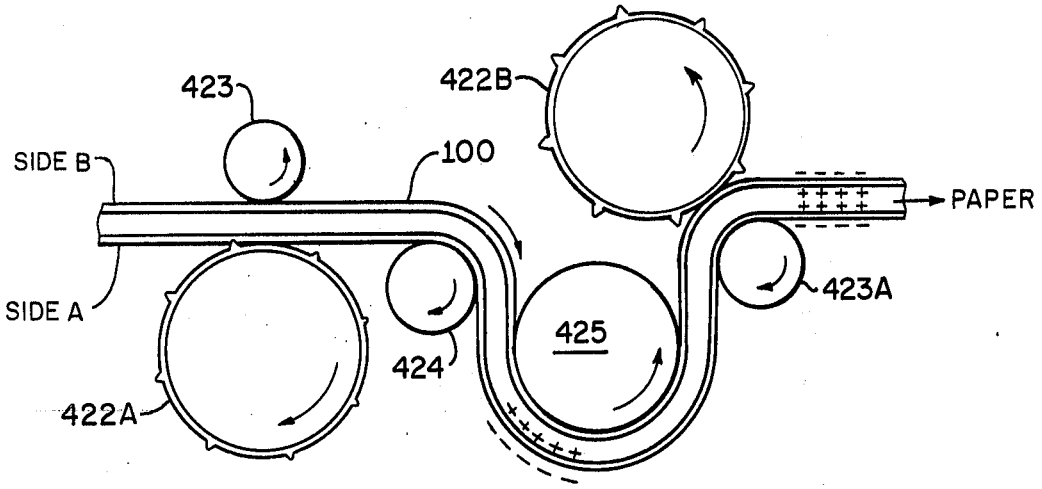
FIG. 4 is a schematic drawing of the formatting apparatus.
Figure 4A:
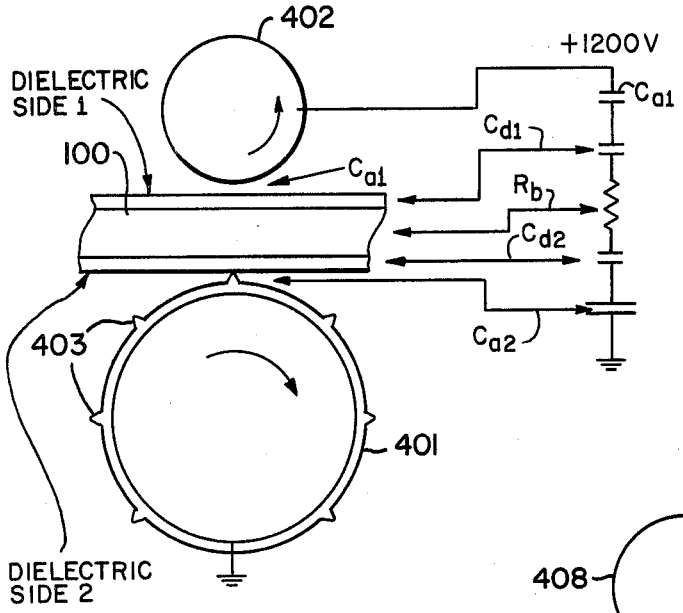
FIG. 4A is a schematic of a format printing station wherein the charging electrode is placed directly opposite the format roller and the resulting equivalent circuit.
Figure 4B:
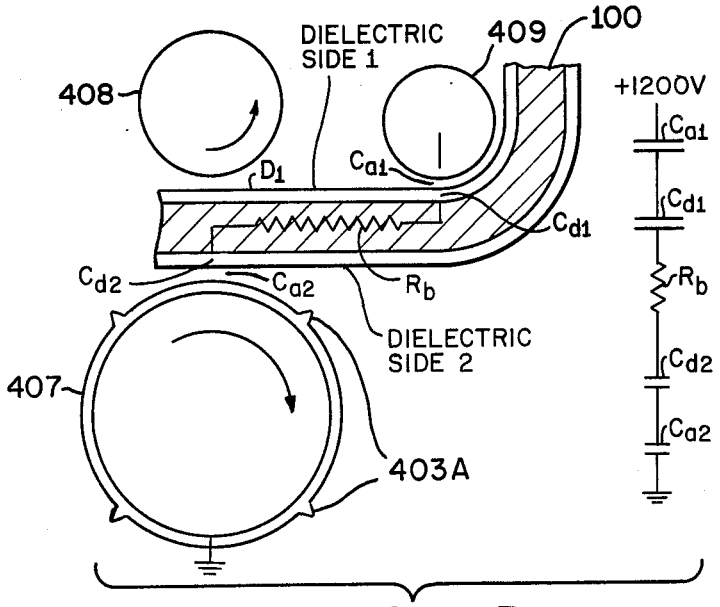
FIG. 4B is a schematic of a format printing station wherein the charging electrode is placed offset from the contact point of the format drum and the resulting equivalent circuit.

Referring now to FIGS. 4, 4A and 4B, the format charging process will be more fully described. FIG. 4 diagrammatically shows a more detailed description of the formatting apparatus. The dielectric paper 100 moves between conductive formatting roller 422A and a non-conductive resilient back-up roller 423 in the direction shown by the arrows. Each conductive roller 422A and 422B has associated with it a non-conductive resilient roller 423 and 423A respectively. Also the speed of each conductive roller 422A, 422B is synchronized so that the format images on each side of the paper are superimposed one with the other. The roller designated by 424 is a non-conductive idler roller for guiding the dielectric paper 100 to charging roller 425. Charging roller 425 is maintained at approximately 1200 volts with respect to rollers 422A and 422B respectively. It should be noted that charging electrode 425 provides charging currents for each of format rollers 422A and 422B respectively. During the charging operation by electrode 425 and format roller 422A, negative charges are depositive on dielectric side A, since format cylinder 422A is maintained at ground potential. Accordingly, positive charges are induced in the base paper because of capacitive coupling. (These positive charges may be induced either by the charging electrodes or by the real flow of current caused by the leakiness of dielectric side B of the paper). It should be noted that if charging electrode 425 were placed immediately opposite format roller 422A, the capacitance between the dielectric paper and the dielectric paper 100 and the roller 422A would be quite small and the probability of air breakdown is large. To illustrate this condition, reference is made to FIG. 4A where format drum 401 is placed directly opposite charging electrode roller 402 with the dielectric paper in between. The equivalent circuit diagram with respect to these rollers and the dielectric paper is also shown. The capacitance of the air gap between roller 402 and dielectric side 1 of paper 100 is denoted by $C_{a1}$; whereas a similar capacitance between format drum 403 and dielectric side number 2 of paper 100 is denoted by $C_{a2}$. The capacitances of the dielectric of the paper for dielectric sides 1 and 2 respectively is denoted by $C_{d1}$ and $C_{d2}$; whereas the resistance of the conductive base of the paper are denoted as $R_b$. The total voltage applied from roller electrode 402 to format roller 401 is 1200 volts. It should be noted from this diagram that the air breakdown capacitance $C_{a1}$ is smaller than the air breakdown capacitance $C_{a2}$. This is necessarily so because format drum 401 must be larger than electrode drum 402 since the design is dictated by the type of format that must be imprinted on the paper. Accordingly, it can readily be seen that the air breakdown would occur on dielectric side number 1 and positive charges would be deposited on dielectric side number 1, which not only would hinder the application of a latent variable image on dielectric side number 1, but would also become developed as background in the toning station. To eliminate the air breakdown on the positive side of the format stations, charging electrode 402 is located offset away from the contact point of the format drum. This arrangement is shown on FIG. 4B.

Referring now to FIG. 4B, it will be seen that format drum 407 is offset with respect to charging electrode 409. A non-conductive resilient roller 408 has been added to apply the proper pressure for the format print drum. Now it will be noted that the relative values of the air breakdown capacitance $C_{a1}$ is much larger than the value of the air breakdown capacitance $C_{a2}$. Similarly, the dielectric capacitance $C_{d1}$ on dielectric side 1 is much larger relative to the dielectric capacitance $C_{d2}$ on dielectric side 2 of the paper medium. Accordingly, this arrangement will deposit negative charges on the surface of dielectric side 2 and induce positive charges between dielectric side 2 and the conductive base. No charges will be induced on dielectric side 1 of the paper medium until the paper reaches format station 2 which is not shown on FIG. 4B but is shown on FIG. 3. At format station 2 a similar process applies negative charges to dielectric side 1.

Figure 6:
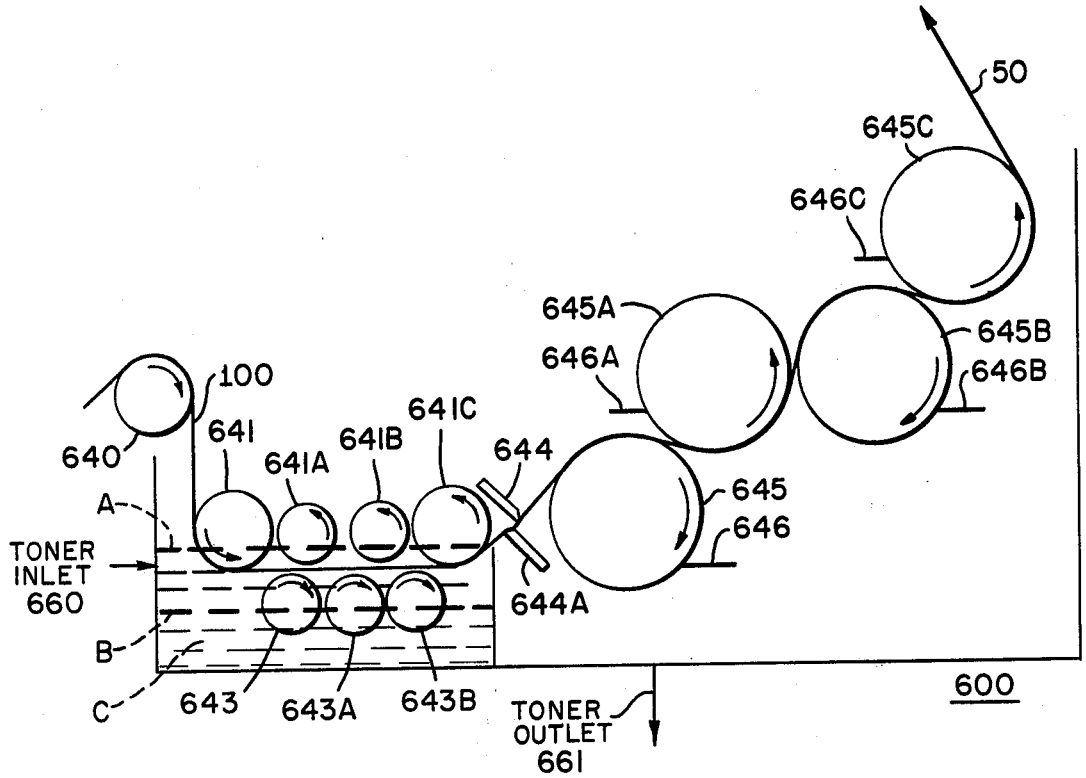
FIG. 6 is a schematic drawing of the two-sided toner station.

Referring now to FIG. 6 the dielectric paper 100 having format charges and variable printing charges on both sides enters toner station 600, over non-conductive idler roller 640. Toner liquid comprised of positively charged carbon colloid suspended in a non-conductive petroleum carrier liquid kerosene (Isopar-L by Exxon) is pumped at the toner inlet 660 and withdrawn at the toner outlet 661. The paper travels between development electrodes 641A, 641B and 643, 643A and 643B. The rollers designated at 641 an 641C are idler rollers for changing the direction of the paper. Although only 5 development electrodes commonly known as transfer rolls are shown, any number may be utilized. The general rule is that the more transfer rolls utilized, the greater will be the print density.

Figure 7:
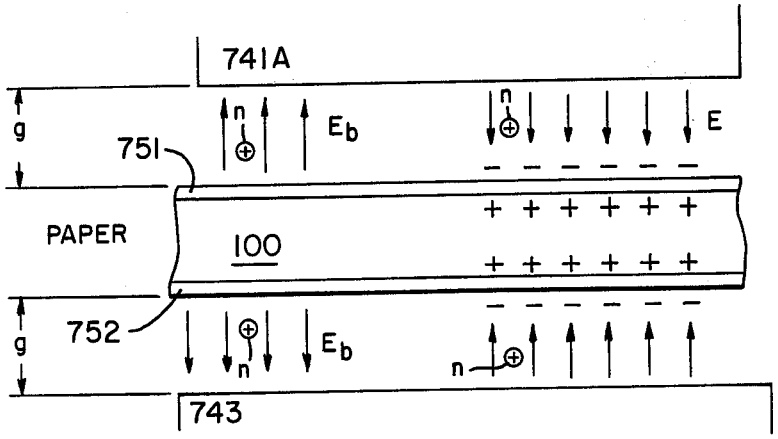
FIG. 7 is a schematic diagram of the toning process.

Referring to FIG. 7, there is shown treated paper 100 having dielectric layers 751, 752 between development electrodes 741A and 743. There is a gap between the development electrodes and the paper. The gap is needed to provide the liquid toner flow between transfer rollers 741A and 743 and the paper. The dielectric surface 751 and 752 of the paper, as noted previously, is now charged negatively with the latent images and accordingly attracts toner particles n which are charged positively. Applied field $E_b$ between the paper and the development electrode is induced in the gap and is equivalent to V/g where V is the voltage difference between conductive base 100 and development electrodes 741A and 743. The positively charged toner particles n are guided under the influence of the field $E_b$ and are attracted away from the dielectric surface which does not have any latent images, hence reducing the background. The electrical field $E_b$ direction is such that the toner particles are forced away from the dielectric surfaces where latent images are not present. In the charged region the induced electrical field E is equivalent to $(I/gc=E_b$. Where I is image charge density, g is the gap, c is the capacitance per unit area of the dielectric layer. This electrical field direction is such that the toner particles are attracted toward the latent image as shown. (The application of toner particles to two sides of a dielectric treated medium is the subject of another invention invented by K. M. Lakhani and entitled "Two-Sided Multi Toner Station for Electrographic Non-Impact Printer," having U.S. Ser. No. 839,692 and filed on 10/5/77 and assigned to the same assignee and filed on an even date with this application, and accordingly will be treated in greater detail in that application).

The treated paper medium leaving the toner reservoir is now in a developed stage i.e. toner particles have been attracted to the charged portion of the paper to make the latent images visible. The paper also has along with the toner particle, some of the liquid carrier in which the toner particles were suspended. It is necessary to reduce this liquid carried out by the paper. The paper therefore then passes over paper scrapers 644 and 644A and onto a set of drying rollers 645, 645A, 645B and 645C. Each of the drying rollers is equipped with a wiper blade 646A–C. By wiping and squeezing the treated paper the excess liquid is reduced to a minimal level and finally is completely evaporated at drying station 318 of FIG. 3. Although four drying rolls are shown, any number may be utilized. The general rule is that the more drying rolls utilized, the more liquid carry out will be reduced.

While the present invention has been described in connection with the particular embodiment thereof, it is to be understood that modification of this embodiment, as well as other embodiments utilizing the underlying principle of the invention are included within the spirit and scope of the invention which is to be limited only by the accompanying claims.

For example the apparatus can use either single-sided or two-sided print paper. Of course, using single-sided paper one can get printing on one side only. When using single-sided paper, charging is reduced to one side only and one electrode head and format is disabled (electrically); also the toner liquid level in the toner station is dropped so that toning is done on one side only.

What is claimed is:

1. In an electrographic printing system of the type wherein a recording medium, comprised of a conductively treated paper base supporting a plastic dielectric coating on each of its sides and moving along a path, has electrographic images formed on each side of said recording medium by selectively applying a high potential across the recording medium and wherein the latent images are subsequently made visible by applying a toner to the medium:

at least one electrographic formatting station for applying a latent image of a predetermined format on each side of said recording medium, wherein said electrographic formatting station includes at least one charging roller on either side of said recording medium, and at least one format roller on each side of said recording medium, offset with each other and with said charging roller in a direction of travel of said recording medium;

an electrode structure on each side of said recording medium, each electrode structure spaced adjacent the path of said recording medium and including a plurality of spaced rows of electrodes, with successive electrodes in each of said rows being spaced from each other, and with the electrodes of successive rows being staggered;

first means for selectively energizing substantially simultaneously each of said electrodes; and second means for continuously maintaining the energization of said selected ones of said electrodes to form elongated latent images substantially simultaneously on each side of said recording medium and substantially longer than the length of the electrodes in the direction of movement of the recording medium.

2. The electrographic printing system as recited in claim 1 wherein said electrographic station is comprised of at least two formatting rollers one on either side of said recording medium and offset relative to each other in a direction of travel of said recording medium, said electrographic station further being comprised of a charging roller on at least one side of said recording medium and offset relative to said format rollers in a direction of travel of said medium.

3. The electrographic printing station as recited in claim 2 wherein said formatting station further includes at least two resilient non-conducting back-up rollers one on each side of said recording medium, one each of said back-up rollers being substantially opposite to one each respectively of said formatting rollers.

4. In an electrographic system of the type wherein a recording medium, comprised of a conductively treated paper base supporting a plastic dielectric coating on each of its sides and moving along a path, has electrographic images formed on each side of said recording medium by selectively applying a high potential across the recording medium and wherein the latent images are subsequently made visible by applying a toner to the medium:

at least one electrographic formatting station for applying a latent image of a predetermined format on each side of said recording medium wherein said electrographic formatting station is comprised of at least one charging roller on either side of said recording medium, and at least one format roller on each side of said recording medium, offset with each other and with said charging roller in a direction of travel of said recording medium;

an electrode structure on each side of said recording medium said electrode structure including a plurality of spaced rows of electrodes, with successive electrodes in each of said rows spaced from each other, and with the electrodes of successive rows being staggered each electrode in said electrode structure being of a smaller dimension in the direction of movement of said medium than the dimension transverse to the movement of said medium, said electrode structure further being spaced adjacent the path of said recording medium;

first means for selectively energizing each of said electrodes; and, second means for continuously maintaining the energization of said selected ones of said electrodes to form elongated latent images substantially simultaneously on each side of said recording medium and substantially longer than the length of the electrodes in the direction of movement of the recording medium.

5. The electrographic printing system as recited in claim 4 wherein said electrographic formatting station is comprised of at least two sets of rollers, each set spaced along the direction of travel of said recording medium, at least one of each set of rollers having a predetermined format thereon, said formatting station further including a charging roller on one side of said recording medium and offset with said sets of rollers in a direction of travel of said recording medium.

6. The electrographic printing system as recited in claim 5 wherein each set of rollers is comprised of a format roller and a back-up roller, one on each side of said recording medium, respectively, with said format roller having a predetermined format thereon.

7. The electrographic printing system as recited in claim 6 wherein said charging roller has a typical voltage of 1200 volts applied thereon.

8. The electrographic printing system as recited in claim 7 wherein said back-up roller is fabricated from resilient non-conductive material.

* * * * *